United States Patent [19]

Pascoe, Sr.

[11] 4,383,404

[45] May 17, 1983

[54] METHOD AND APPARATUS TO PRODUCE POST HEATED TEXTURED YARN

[75] Inventor: William M. Pascoe, Sr., Spartanburg, S.C.

[73] Assignee: Milliken Research Corporation, Spartanburg, S.C.

[21] Appl. No.: 296,106

[22] Filed: Aug. 26, 1981

[51] Int. Cl.[3] ..... D02G 3/34; D01H 13/28

[52] U.S. Cl. ..... 57/284; 57/208

[58] Field of Search ..... 57/206, 208, 209, 282, 57/283, 284, 290, 309, 351; 28/252, 253, 258, 28/281

[56] References Cited

U.S. PATENT DOCUMENTS

| | | | |
|---|---|---|---|
| Re. 28,406 | 5/1975 | Buzano | 28/72.17 |
| 2,373,194 | 4/1945 | Luttge | 28/78 |
| 2,373,195 | 4/1945 | Wedler | 8/114.5 |
| 2,700,205 | 1/1955 | Rice | 28/72 |
| 2,790,225 | 4/1957 | Cogovan et al. | 28/72 |
| 2,815,558 | 12/1957 | Bartovics et al. | 28/72 |
| 2,875,504 | 3/1959 | White | 28/72 |
| 2,988,800 | 6/1961 | White | 28/72 |
| 3,010,179 | 11/1961 | Thal | 28/72 |
| 3,091,909 | 6/1963 | Taylor et al. | 57/34 |
| 3,093,955 | 6/1963 | Cadario | 57/34 |
| 3,129,485 | 4/1964 | Shattuck | 57/208 X |
| 3,137,911 | 6/1964 | Bromley | 28/1 |
| 3,153,106 | 10/1964 | Schlick . | |
| 3,171,484 | 3/1965 | Thal | 161/63 |
| 3,256,581 | 6/1966 | Thal et al. | 26/2 |
| 3,275,732 | 6/1966 | Macleod et al. | 264/290 |
| 3,284,871 | 11/1966 | Yano et al. | 28/253 |
| 3,325,988 | 6/1967 | Klein et al. | 57/140 |
| 3,376,698 | 4/1968 | Whittaker et al. | 57/34 |
| 3,408,716 | 11/1968 | Tradewell | 28/62 |
| 3,585,098 | 6/1971 | Truscott et al. | 161/63 |
| 3,596,334 | 8/1971 | Kobayashi . | |
| 3,613,186 | 10/1971 | Mazzone et al. | 26/2 R |
| 3,662,055 | 5/1972 | Bates | 264/167 |
| 3,681,912 | 8/1972 | Silverman | 57/157 |
| 3,683,610 | 8/1972 | Buzano | 57/140 J |
| 3,691,748 | 9/1972 | Buzano | 57/140 J |
| 3,729,784 | 5/1973 | Mazzone et al. | 26/2 R |
| 3,774,272 | 11/1973 | Rubaschek | 26/140 |
| 3,846,970 | 11/1974 | Hitomi et al. | 57/140 |
| 4,043,108 | 8/1977 | Reese | 57/157 |
| 4,054,025 | 10/1977 | Kubitzek et al. | 57/157 |
| 4,096,222 | 6/1978 | Bosley | 57/208 X |
| 4,244,177 | 1/1981 | Wurmli | 57/353 |

FOREIGN PATENT DOCUMENTS

| | | |
|---|---|---|
| 1227967 | 6/1969 | France . |
| 592309 | 5/1959 | Italy . |
| 352263 | 3/1961 | Switzerland . |
| 878392 | 6/1959 | United Kingdom . |

*Primary Examiner*—Donald Watkins

*Attorney, Agent, or Firm*—Earle R. Marden; H. William Petry

[57] ABSTRACT

Method and apparatus to produce a novelty textured yarn by intermittently blowing hot air at high temperatures into a tube through which previously textured yarn is passing. This produces a yarn having spaced, detextured portions along the length thereof.

7 Claims, 7 Drawing Figures

METHOD AND APPARATUS TO PRODUCE POST HEATED TEXTURED YARN

This invention relates to textured yarn and in particular to methods and apparatus which treat textured yarn to provide a novelty effect therein which results in improved hand and novel dye characteristics.

Therefore, it is an object of the invention to provide a new and novel textured yarn.

Other objects and advantages of the invention will become readily apparent as the specification proceeds to describe the invention with reference to the accompanying drawings in which.

Figure 1:
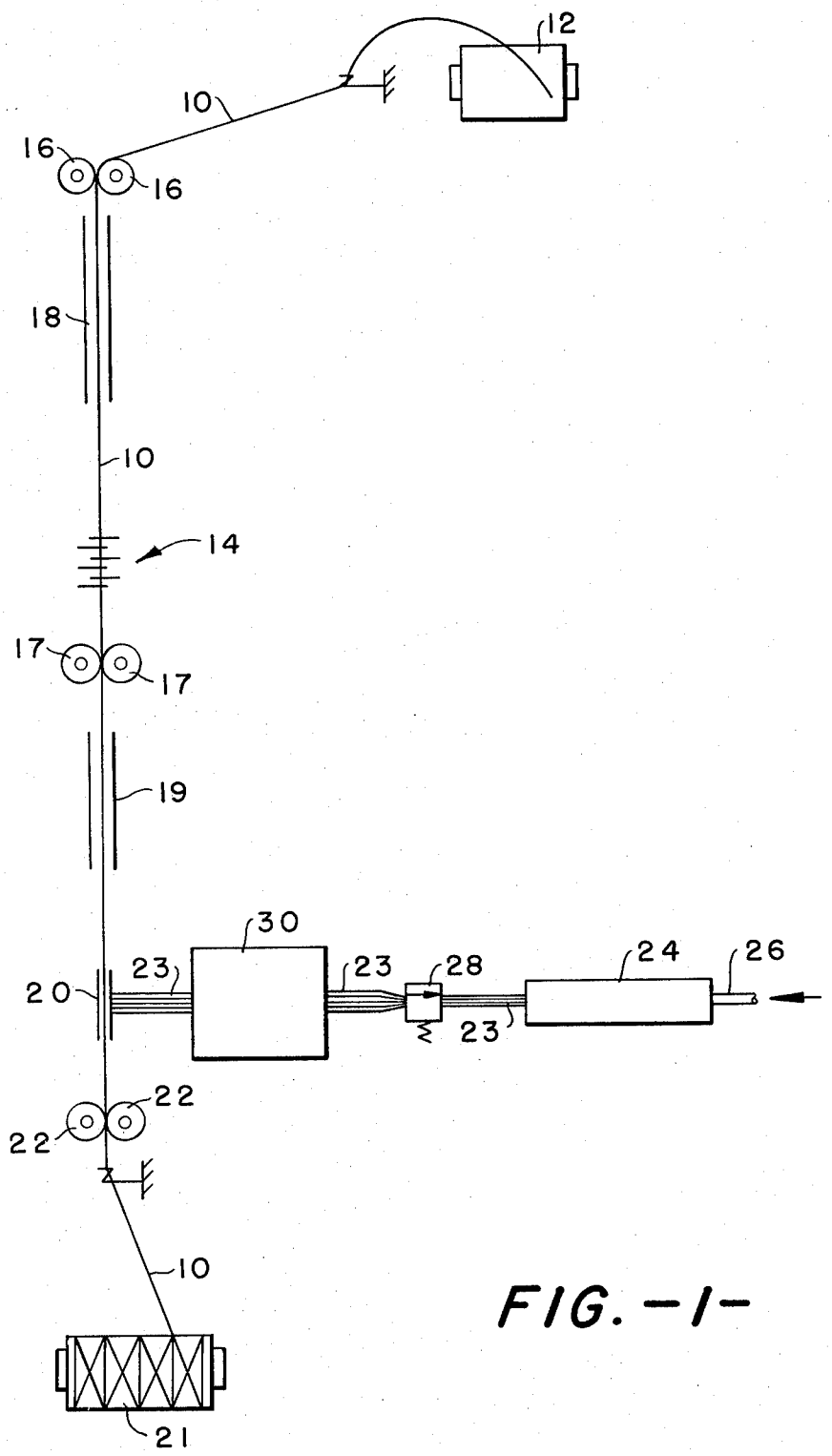
FIG. 1 is a schematic view of the new and improved yarn process.

Looking now to the drawings, and especially FIG. 1, there is shown one embodiment for producing a novel textured yarn 10. The yarn 10 is preferably a multi-filament, partially oriented polyester yarn, but obviously other partially oriented or fully oriented synthetic, continuous filament yarn such as nylon or other orientable, crystallizable thermopolymers can be employed, if desired.

FIG. 1 schematically represents one position of a multi-position texturing machine in which the yarn 10 from a package 12 is false twisted by a false twist device 14, represented by friction discs, after being delivered thereto by feed rolls 16 through the primary heater 18. From the false twist device 14, the yarn 10 is delivered by the feed rolls 17 through the secondary heater 19, if desired, and into the heating tube 20 wherein it is intermittently detextured. The yarn 10 is then delivered to the take-up package 12 by the third set of feed rolls 22.

The heating tube 20 is supplied air at a temperature of between 600°–800° F., preferably 750° F., by a plurality of small air tubes 23 connected through the wall of the heating tube 20. The air is supplied from a source of air under pressure, such as an air compressor, not shown, into the manifold or receiver 24 via conduit 26. The air tubes 23 are connected to the receiver 24 and pass to the heating tube 18 successively through the solenoid control valve 28 and the air heater 30. The control valve 28 is intermittently actuated by a pulse from a random signal generator, such as disclosed in U.S. Pat. No. 4,160,359, to randomly and intermittently supply hot air against the yarn 10 as it passes through the heating tube 20. The heating tube 20 has an elongated slot 32 therein for easy thread-up of the yarn 10 treated in the tube 20.

Figure 2:
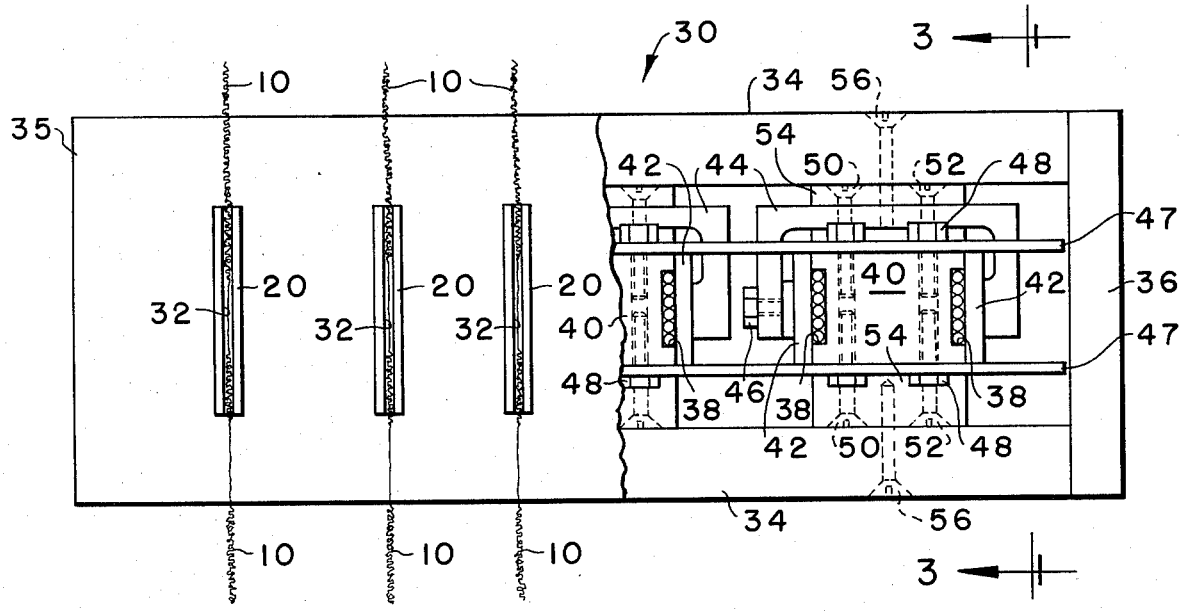
FIG. 2 is a front view, partially broken away, of the new and improved hot air yarn heater.
Figure 3:
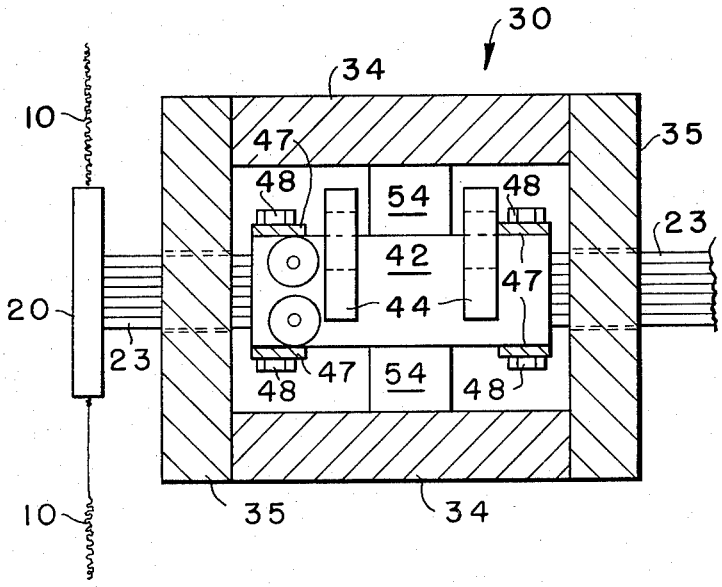
FIG. 3 is a view of the yarn heater of FIG. 2 taken on line 3—3.

FIGS. 2 and 3 represent a heater for six positions, but obviously the number of positions is dependent on the desires of the user. The heater 30 is enclosed by suitable insulation blocks 34, 35 and 36 and the hot air tubes 23 project through an opening in the front block 35 to support the yarn heater 20 in the path of travel of the textured yarn 10. The plurality of hot air tubes 23 for each yarn heater 20 are considered a set and in the preferred embodiment of the invention two sets of hot air tubes 23 are mounted in grooves 38 in the same aluminum support block 40 on opposite sides thereof. On each side of the aluminum support block 40 is an elongated electric resistance type Calrod heater 42 which abuts the tubes in the grooves 38 and heats the air passing through the tubes. To maintain the two heaters 42 and the two sets of hot air tubes 23 in assembled relationship in the longitudinal direction, U-shaped clamps 44 telescope the assembled parts and are held in such relation by a screw 46. To maintain the assembled heaters, tubes and aluminum block in correct vertical alignment, a pair of elongated, narrow slats 47 are mounted on the top and bottom of the aluminum blocks 40 and secured thereto by screws 48. Mounted to the top and bottom of each aluminum block, by suitable screws 50 and 52 is an insulation block 54. The insulation blocks 54 support the upper and lower insulation blocks 34 secured thereto by screws 56. The other insulation blocks 35 and 36 are secured to the sides of the upper and lower blocks 34 by a suitable adhesive or other means.

OPERATION

Figure 4:
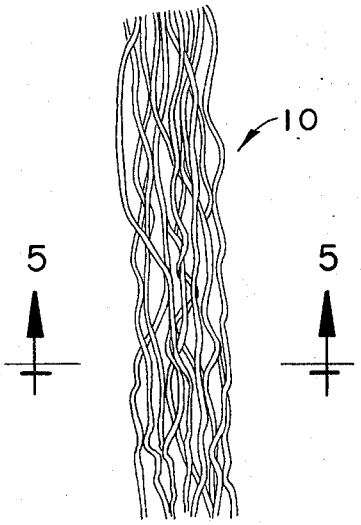
FIG. 4 is a schematic representation of a textured multifilament, synthetic, continuous control yarn which has not been treated by the yarn heater of FIGS. 1–3.
Figure 5:
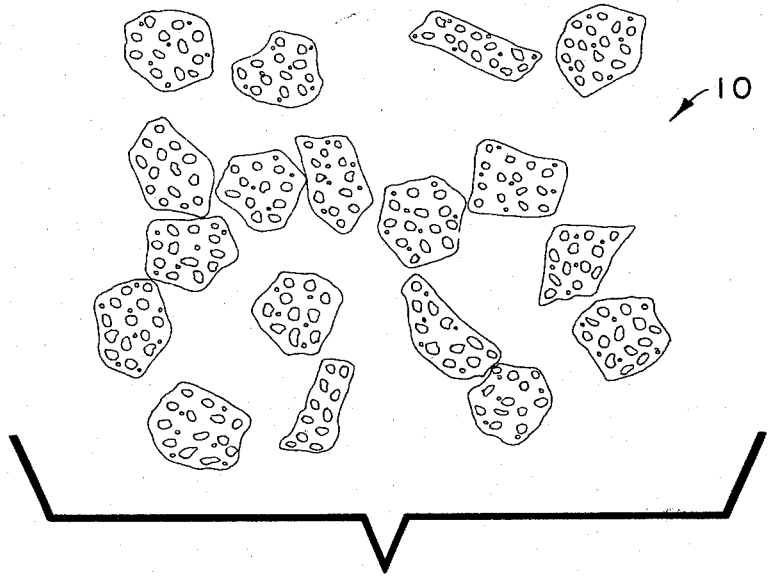
FIG. 5 is a cross-section of the fiber in FIG. 4.
Figure 6:
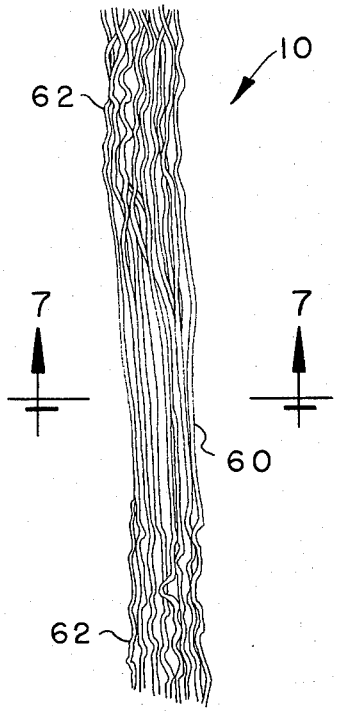
FIG. 6 is a schematic view of the intermittently heated textured yarn produced by the invention.
Figure 7:
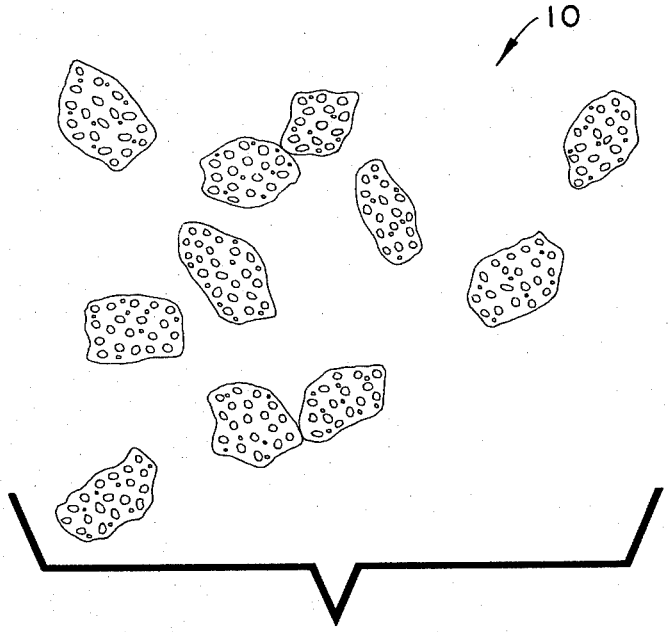
FIG. 7 is a cross-section view taken on line 7—7 of FIG. 6 showing the detextured fiber in cross-section.

FIGS. 4–7 represent a DuPont 56T, 1/150168 polyester yarn which has been textured as shown in FIG. 2 with the yarn shown in FIGS. 6 and 7 having portions thereof detextured in the air heating tube 20. It should be noted that yarn 10 prior to false twisting has filaments having a circular configuration but, as shown in both FIGS. 5 and 7, they are given a rhombic cross-section with substantially sharp edges by the false twisting thereof. This configuration, as indicated in FIG. 7, is maintained, after the detexturing of the yarn so that the filaments of the detextured yarn have a cross-sectional configuration of a textured yarn and the general appearance of an untextured yarn.

In operation, the speed of the rolls 17 and 22 is adjusted to pull the yarn 10 into a straight configuration in the tube 20 and is run therethrough at a speed of 140 yards/minute. Then the valve 28 is randomly and intermittently actuated to supply bursts of hot air from the heater 30 through the tubes 23 into the heating tube 20 at a temperature of approximately 750° F. This temperature will cause the portion 60 of the yarn to be set in a straight configuration while the portions 62 of the yarn 10 will retain their texture since these portions have not been subjected to the intermittent blast of hot air.

Using a standard crystallinity test and plotting the x-ray intensity of each of the two yarns shown in FIGS. 4–7 against the defraction angle, the crystallinity index of the control yarn of FIGS. 4 and 5 is 0.600 while the crystallinity of the detextured portions 60 of the yarn in FIGS. 6 and 7 is 0.624. This increase in crystallinity of the detextured portions 60 provides a yarn with portions thereof which have different physical and dyeability characteristics than other portions of the same yarn. This effect, of course, is accentuated when the yarn 10 is used to produce a fabric.

It is contemplated that many changes or modifications may be made within the embodiment of the invention disclosed without departing from the spirit or scope of the invention and it is desired that the invention be limited only by the claims.

I claim:

1. The method of producing a novel false twist textured yarn comprising the steps of: false twisting a synthetic, continuous filament yarn, supplying the false twisted yarn to a heating zone, intermittently blowing a plurality of streams of high temperature hot gaseous fluid against the false twisted yarn in the heating zone to detexture portions of the yarn and taking up the partially detextured, false twisted yarn.

2. The method of claim 1 wherein the temperature of the hot gaseous fluid is in the range of 600° F. to 800° F.

3. The method of claim 1 wherein the plurality of streams of high temperature hot gaseous fluid is supplied through elongated tubes from a source of high pressure air.

4. The method of claim 3 wherein the temperature of the hot gaseous fluid is in the range of 600° F. to 800° F.

5. The method of claim 4 wherein the temperature of the hot gaseous fluid is approximately 750° F.

6. Apparatus to provide a novel false twisted yarn comprising: a first tube having a passage therethrough, means to supply a false twisted yarn into said passage in said tube and means to take-up yarn from said passage, a plurality of tubes connected to said first tube and opening into said passage to blow hot gaseous fluid into said passage, means to supply air under pressure into said plurality of tubes, means operably connected to said plurality of tubes to heat the air in said tubes to a high temperature and means operably associated with said tubes to allow the air supplied thereto to be intermittently transmitted to said passage in said first tube.

7. The apparatus of claim 6 wherein said means to heat the air is an electrical heater.

* * * * *